US011512363B2

(12) United States Patent
Yamashita

(10) Patent No.: US 11,512,363 B2
(45) Date of Patent: Nov. 29, 2022

(54) METHOD FOR PRODUCING METAL FOILS AND APPARATUS FOR PRODUCING METAL FOILS

(71) Applicant: TOYOTA JIDOSHA KABUSHIKI KAISHA, Toyota (JP)

(72) Inventor: Osamu Yamashita, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 19 days.

(21) Appl. No.: 17/128,432

(22) Filed: Dec. 21, 2020

(65) Prior Publication Data

US 2021/0207238 A1 Jul. 8, 2021

(30) Foreign Application Priority Data

Jan. 8, 2020 (JP) ..... JP2020-001477

(51) Int. Cl.

| | |
|---|---|
| ***H01F 41/02*** | (2006.01) |
| ***C21D 9/46*** | (2006.01) |
| ***H01F 1/14*** | (2006.01) |
| ***C21D 6/00*** | (2006.01) |
| *H01F 41/00* | (2006.01) |

(52) U.S. Cl.

CPC ..... *C21D 9/46* (2013.01); *C21D 6/008* (2013.01); *H01F 1/14* (2013.01); *C21D 2201/03* (2013.01); *H01F 41/00* (2013.01)

(58) Field of Classification Search

None

See application file for complete search history.

(56) References Cited

U.S. PATENT DOCUMENTS

2017/0229237 A1 8/2017 Makino et al.
2019/0077622 A1 3/2019 Ando et al.
(Continued)

FOREIGN PATENT DOCUMENTS

CN 104139996 A 11/2014
CN 107043847 A 8/2017
(Continued)

OTHER PUBLICATIONS

Non-Final Office Action dated Dec. 23, 2021 issued in U.S. Appl. No. 16/876,719.
(Continued)

*Primary Examiner* — Anthony M Liang
(74) *Attorney, Agent, or Firm* — Sughrue Mion, PLLC

(57) ABSTRACT

There is provided a method for producing metal foils, capable of easily crystalizing amorphous soft magnetic material of a plurality of metal foils into nano-crystal soft magnetic material by uniformly heating the metal foils. A laminate obtained by laminating the metal foils made of amorphous soft magnetic material is held by a holding member such that adjacent metal foils can be separated from each other in a laminated direction of the laminate. By conveying either the holding member or magnets in a direction perpendicular to the laminated direction as a conveying direction such that the holding member and the magnets come close to each other, the adjacent metal foils are separated from each other with a magnetic force of the magnets. The separated metal foils are heated to crystalize the amorphous soft magnetic material of the metal foils into nano-crystal soft magnetic material. The same magnetic pole of the magnets aligns in the laminated direction.

2 Claims, 8 Drawing Sheets

(56) References Cited

U.S. PATENT DOCUMENTS

| | | | |
|---|---|---|---|
| 2019/0123376 | A1 | 4/2019 | Ando et al. |
| 2019/0157921 | A1 | 5/2019 | Nishikawa et al. |
| 2020/0373084 | A1 | 11/2020 | Yamashita |

FOREIGN PATENT DOCUMENTS

| | | | |
|---|---|---|---|
| CN | 108778967 | A | 11/2018 |
| CN | 109417318 | A | 3/2019 |
| JP | 2017-141508 | A | 8/2017 |
| JP | 2017-185675 | A | 10/2017 |
| JP | 2020-189774 | A | 11/2020 |

OTHER PUBLICATIONS

Notice of Allowance dated May 4, 2022 issued in U.S. Appl. No. 16/876,719.
Corrected Notice of Allowability dated Jun. 10, 2022, issued in U.S. Appl. No. 16/876,719.

METHOD FOR PRODUCING METAL FOILS AND APPARATUS FOR PRODUCING METAL FOILS

CROSS REFERENCE TO RELATED APPLICATIONS

The present application claims priority from Japanese patent application JP 2020-001477 filed on Jan. 8, 2020, the entire content of which is hereby incorporated by reference into this application.

BACKGROUND

Technical Field

The present invention relates to a method for producing nano-crystal metal foils made of nano-crystal soft magnetic material and an apparatus for producing nano-crystal metal foils.

BACKGROUND ART

Conventional motors, transformers, and the like use a laminate obtained by laminating metal foils as a core. For example, JP 2017-141508 A suggests a method for producing metal foils, including heating metal foils made of amorphous soft magnetic material in a laminated state to crystalize the amorphous soft magnetic material of the metal foils into nano-crystal soft magnetic material.

SUMMARY

It is commonly known that when amorphous soft magnetic material is crystalized into nano-crystal soft magnetic material, the material generates heat by itself. Therefore, as described in JP 2017-141508 A, for example, heating metal foils in a laminated state may cause the metal foils to be excessively heated due to the accumulation of heat generated by the material between the metal foils. Furthermore, among the laminated metal foils, variation in heating temperature occurs between the metal foils located inside and the metal foils located outside.

In view of the foregoing, if a plurality of metal foils is heated while separated from each other, instead of being laminated on each other, each metal foil can be uniformly heated. However, the process of separating the plurality of metal foils one by one requires enormous amounts of time.

The present disclosure has been made in view of the foregoing, and the present disclosure provides a method for producing metal foils, capable of easily crystalizing amorphous soft magnetic material of a plurality of metal foils into nano-crystal soft magnetic material by uniformly heating the metal foils.

The method for producing metal foils according to the present disclosure is a method for producing metal foils made of nano-crystal soft magnetic material, the method including holding by a holding member a laminate obtained by laminating metal foils made of amorphous soft magnetic material such that adjacent metal foils can be separated from each other in a laminated direction of the laminate; conveying either the holding member or one or more magnets in a direction perpendicular to the laminated direction as a conveying direction such that the holding member and the one or more magnets come close to each other, thereby separating the adjacent metal foils with a magnetic force of the one or more magnets; and heating the separated metal foils to crystalize the amorphous soft magnetic material of the metal foils into nano-crystal soft magnetic material. The same magnetic pole of the one or more magnets aligns in the laminated direction.

According to the present disclosure, by conveying either the holding member or the one or more magnets such that the holding member and the one or more magnets come close to each other, the metal foils in the laminate held by the holding member are magnetized by the magnets. The magnetized metal foils repel each other and are held by the holding member while a gap is formed between the adjacent metal foils. In the present disclosure, since the same magnetic pole of the magnets aligns in the laminated direction of the laminate, a magnetic force (magnetic flux) oriented in the same direction tends to be formed in the laminated direction. Part of the metal foils magnetized by the magnetic force is less likely to be inclined with respect to the laminated direction when separated from each other. As a result, it is possible to prevent the adjacent metal foils from coming into contact with each other with a gap therebetween.

In this manner, the adjacent metal foils do not come into contact with each other and the plurality of metal foils can be held by the holding member while separated from each other. With respect to the metal foils held in this way, when the plurality of amorphous metal foils is heated so that the amorphous soft magnetic material is crystalized, heat is inputted into each amorphous metal foil.

During the crystallization, each metal foil generates heat by itself, but since the generated heat is discharged through the gap between the metal foils, it is possible to avoid an excessive temperature rise of the metal foils. As a result, each metal foil can be uniformly heated, and a metal foil made of nano-crystal soft magnetic material having a uniform crystal structure can be obtained.

In some embodiment, a plurality of rows each including the one or more magnets is arranged with a gap therebetween in the conveying direction, the one or more magnets forming the plurality of rows are arranged such that a range of the magnetic force acting on the metal foils widens in the laminated direction as the holding member advances in the conveying direction, and in the separating, the metal foils held by the holding member are sequentially passed over the one or more magnets in each of the plurality of rows in the conveying direction, thereby separating the metal foils from each other.

According to this aspect, with such arrangements of the magnets, when the laminate is sequentially passed over the magnets in the respective rows in the conveying direction, the adjacent metal foils are gradually separated from each other with a larger gap therebetween in the laminated direction. Therefore, when separated from each other, part of the magnetized metal foils is less likely to be inclined with respect to the laminated direction. As a result, it is possible to prevent the adjacent metal foils from coming into contact with each other with a gap therebetween.

Herein, there is also disclosed a producing apparatus adapted to perform the aforementioned method for producing metal foils. The producing apparatus according to the present disclosure is an apparatus for producing metal foils made of nano-crystal soft magnetic material, the apparatus including: a holding member configured to hold a laminate obtained by laminating metal foils made of amorphous soft magnetic material such that adjacent metal foils can be separated from each other in a laminated direction of the laminate; one or more magnets configured to separate the adjacent metal foils in the laminate held by the holding member with a magnetic force; a conveying device configured to convey either the holding member or the one or more magnets in a direction perpendicular to the laminated direction as a conveying direction such that the holding member and the one or more magnets come close to each other; and a heating device configured to heat the separated metal foils to crystalize the amorphous soft magnetic material of the metal foils into nano-crystal soft magnetic material. The same magnetic pole of the one or more magnets aligns in the laminated direction.

According to the present disclosure, the holding member holds the laminate obtained by laminating the metal foils made of amorphous soft magnetic material. Next, the conveying device conveys either the holding member or the magnets such that the holding member and the magnets come close to each other, whereby the metal foils, which are magnetized by the magnetic force of the magnets, repel each other and the adjacent metal foils can be separated from each other. Since the same magnetic pole of the magnets aligns in the laminated direction, magnetic lines of force (magnetic flux) tend to be formed in the same direction in the laminated direction. Part of the metal foils magnetized by the magnetic force is less likely to be inclined with respect to the laminated direction, and thus it is possible to prevent the adjacent metal foils from coming into contact with each other.

In this manner, while the adjacent metal foils are not in contact with each other and are separated from each other at equal intervals, the heating device heats the plurality of amorphous metal foils so that the amorphous soft magnetic material is crystalized. Accordingly, heat is inputted into each amorphous metal foil, and during this crystallization, each metal foil generates heat by itself, but since the generated heat is discharged through the gap between the metal foils, it is possible to avoid an excessive temperature rise of the metal foil. As a result, each metal foil can be uniformly heated, and the metal foils made of nano-crystal soft magnetic material having a uniform crystal structure can be obtained.

In some embodiments, a plurality of rows each including the one or more magnets is arranged with a gap therebetween in the conveying direction, and the one or more magnets forming the plurality of rows are arranged such that a range of the magnetic force acting on the metal foils widens in the laminated direction as the holding member advances in the conveying direction.

According to this aspect, with such arrangements of the magnets, when the conveying device sequentially passes the laminate over the magnets in the respective rows in the conveying direction, the adjacent metal foils are gradually separated from each other with a larger gap therebetween in the laminated direction. Therefore, the magnetized metal foils are less likely to be inclined with respect to the laminated direction. As a result, the adjacent metal foils are more likely to be separated from each other at equal intervals, and thus it is possible to prevent the adjacent metal foils from coming into contact with each other.

According to the method for producing metal foils of the present disclosure, a plurality of metal foils made of amorphous soft magnetic material is uniformly heated so that the amorphous soft magnetic material can be easily crystalized into nano-crystal soft magnetic material having a uniform crystal structure.

DETAILED DESCRIPTION

Figure 1:
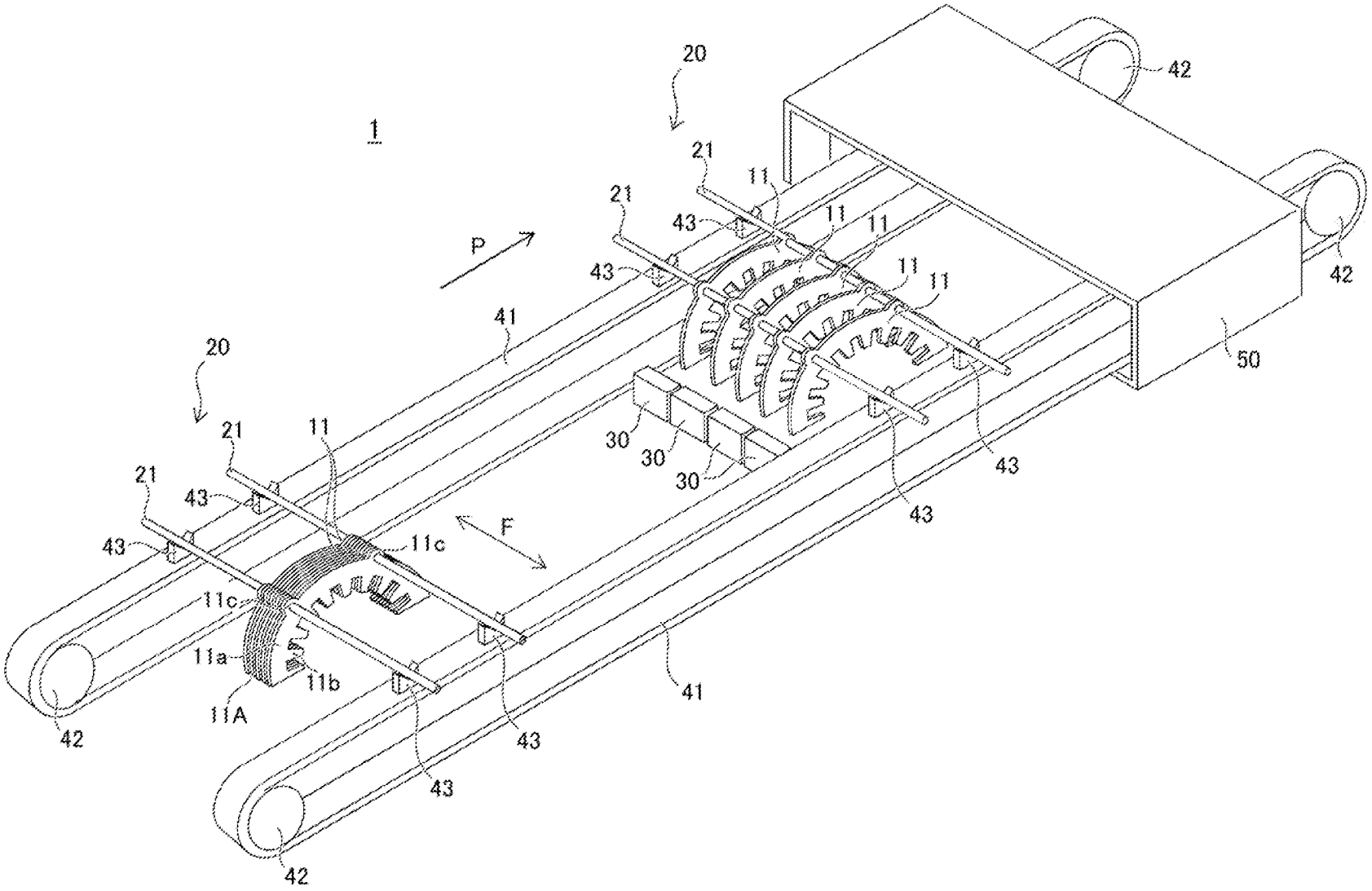
FIG. 1 is a schematic perspective view showing a producing apparatus adapted to perform a method for producing metal foils according to a first embodiment of the present disclosure.

Hereinafter, a method for producing metal foils according to the present disclosure will be described with reference to the drawings. With reference to FIG. 1 to FIG. 7B, metal foils to be used will be described first, and then a production method therefor according to each embodiment will be described.

Metal Foils 11

Metal foils produced in the present embodiment are metal foils made of nano-crystal soft magnetic material. The production method described below includes applying heat treatment to metal foils made of amorphous soft magnetic material to crystalize the amorphous soft magnetic material into nano-crystal soft magnetic material, thereby producing metal foils.

Now, amorphous soft magnetic material or nano-crystal soft magnetic material forming metal foils will be described. Examples of the amorphous soft magnetic material and nano-crystal soft magnetic material include, but are not limited to, material containing at least one magnetic metal selected from the group consisting of Fe, Co, and Ni and at least one non-magnetic metal selected from the group consisting of B, C, P, Al, Si, Ti, V, Cr, Mn, Cu, Y, Zr, Nb, Mo, Hf, Ta, and W.

Typical examples of the amorphous soft magnetic material or nano-crystal soft magnetic material include, but are not limited to, a FeCo-based alloy (e.g., FeCo and FeCoV), a FeNi-based alloy (e.g., FeNi, FeNiMo, FeNiCr, and FeNiSi), a FeAl-based alloy or a FeSi-based alloy (e.g., FeAl, FeAlSi, FeAlSiCr, FeAlSiTiRu, and FeAlO), a FeTa-based alloy (e.g., FeTa, FeTaC, and FeTaN) or a FeZr-based alloy (e.g., FeZrN). A Fe-based alloy may contain at least 80 at % of Fe.

As another example of the amorphous soft magnetic material or nano-crystal soft magnetic material, a Co-based alloy containing Co and at least one of Zr, Hf, Nb, Ta, Ti, or Y may be used. The Co-based alloy may contain at least 80 at % of Co. Such a Co-based alloy is likely to become an amorphous state when it is deposited as a film, and exhibits excellent soft magnetism because it has small magnetocrystalline anisotropy and few crystal defects and grain boundaries. Examples of the amorphous soft magnetic material include CoZr, CoZrNb, and CoZrTa-based alloys.

The amorphous soft magnetic material as used herein is soft magnetic material having an amorphous structure as a main structure. In the amorphous structure, no clear peak appears in an X-ray diffraction pattern, and only a broad halo pattern can be observed. Meanwhile, a nano-crystal structure can be formed by applying heat treatment to the amorphous structure, and in a nano-crystal soft magnetic material having a nano-crystal structure, a diffraction peak can be observed in a position corresponding to a gap between lattice points on the crystal plane. Based on the width of the diffraction peak, the crystallite size can be calculated with the Scherrer equation.

In the nano-crystal soft magnetic material as used herein, each nano-crystal has a crystallite size of less than 1 μm as calculated with the Scherrer equation based on the full width at half maximum (FWHM) of a diffraction peak of an X-ray diffraction pattern. In the present embodiment, the crystallite size of each nano-crystal (the crystallite size as calculated with the Scherrer equation based on the full width at half maximum (FWHM) of a diffraction peak of an X-ray diffraction) may be equal to or less than 100 nm, or equal to or less than 50 nm. In addition, the crystallite size of each nano-crystal may be equal to or greater than 5 nm. If nano-crystals have a crystallite size within such a range, magnetic properties can be improved. Meanwhile, the crystallite size of a conventional electromagnetic steel sheet is of the order of μm, and typically equal to or greater than 50 μm.

The amorphous soft magnetic material can be obtained by, for example, melting metal material, which has been prepared to have the above-mentioned composition, at a high temperature in a high-frequency melting furnace or the like to obtain a uniform molten metal and quenching the result. The quenching rate is, for example, about $10^{6\circ}$ C./sec, though it depends on the material used. However, the quenching rate is not particularly limited as long as an amorphous structure can be obtained before the material crystallizes. In the present embodiment, the metal foil as will be described later can be obtained by blowing the molten metal of the metal material onto a rotating cooling roll to produce a metal foil strip made of amorphous soft magnetic material and forming the strip into a desired shape by punching, for example. In this manner, quenching a molten metal can obtain soft magnetic material having an amorphous structure before the material crystalizes. The metal foil may have a thickness not greater than 0.05 mm, for example, and not less than 0.01 mm, for example. It should be noted that in the drawings as will be described later, the metal foil formed is a rectangular metal foil or a fan-shaped metal foil according to the shape of a rotor core of a motor, but the shape of the metal foil is not limited to them.

In the present embodiment, metal foils made of nano-crystal soft magnetic material are produced from the thus-prepared metal foils made of amorphous soft magnetic material. Now, some embodiments according to the present disclosure will be described.

First Embodiment

1. Producing Apparatus 1 Producing Metal Foils 11

As shown in FIG. 1, a producing apparatus 1 produces metal foils 11 made of nano-crystal soft magnetic material by heating the metal foils 11 made of amorphous soft magnetic material.

In the present embodiment, the metal foils 11 punched out according to the shape of a stator of a motor are used. Each of the metal foils 11 includes a portion 11*a* corresponding to a yoke of the stator and a portion 11*b* corresponding to teeth of the stator. The peripheral edge of the portion 11*a* corresponding to a yoke has two through holes 11*c* serving as fixing holes for fixing the yoke. The producing apparatus 1 described below crystalizes amorphous soft magnetic material of the metal foils 11 into nano-crystal soft magnetic material.

The producing apparatus 1 includes a holding member 20 that holds a laminate 11A obtained by laminating the metal foils 11, a plurality of magnets 30 that separates the metal foils 11 in the laminate 11A from each other, a conveying device 40 that conveys the holding member 20, and a heating device 50 that heats the metal foils 11 held by the holding member 20.

2-1. Holding Member 20

The holding member 20 holds the laminate 11A obtained by laminating the metal foils 11 made of amorphous soft magnetic material such that the adjacent metal foils 11 may be separated from each other in the laminated direction F of the laminate 11A. As used herein, the phrase "may be separated from each other" means that the adjacent metal foils 11 are not tied to each other and can slide on the holding member 20 with magnetic force so as to be separated from each other with a constant gap formed therebetween.

The holding member 20 includes a pair of holding bars 21, 21 made of stainless steel or an aluminum alloy. The pair of holding bars 21, 21 is disposed side by side, and the respective holding bars 21, 21 are inserted into the respective through holes 11*c* of the metal foils 11. The shape of the holding bar 21 is not particularly limited as long as the metal foils 11 are slidable in a longitudinal direction of the holding bar 21.

2-2. Magnets 30

The magnets 30 allow the adjacent metal foils 11 in the laminate 11A held by the holding member 20 to be separated from each other with the magnetic force of the magnets 30. In the present embodiment, the magnet 30 is a permanent magnet. For the magnet 30, a rare-earth magnet, such as a neodymium magnet mainly including neodymium, iron, and boron and a samarium-cobalt magnet mainly including samarium and cobalt, is used. In addition, a ferrite magnet, an alnico magnet, and the like may also be used.

The magnet 30 may also be an electromagnet including an iron core and a coil. Four magnets 30 are disposed in the laminated direction F. However, the number of magnets 30 is not particularly limited as long as the adjacent metal foils 11, 11 can be separated from each other. The magnets may be formed as a single magnet.

Figure 3A:
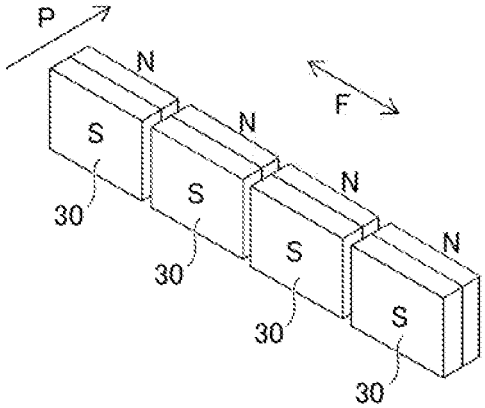
FIG. 3A is a schematic perspective view for explaining the arrangement of magnets shown in FIG. 1.

The magnet 30 has magnetic poles, that is, the north pole and the south pole. In the present embodiment, the magnets 30 are arranged such that the same magnetic pole aligns in the laminated direction F. More specifically, in the present embodiment, the same magnetic pole of the plurality of magnets 30 arranged in the laminated direction F aligns as shown in FIG. 3A. That is, the magnetic pole in the upstream side of a conveying direction P is the south pole, and the magnetic pole in the downstream side of the conveying direction P is the north pole.

In the present embodiment, since the magnetic poles of the magnets 30 respectively align in the laminated direction F of the laminate 11A, a magnetic force (magnetic flux) oriented in the same direction tends to be formed in the laminated direction F. With the magnetic force formed in this manner, the adjacent metal foils 11 can be separated from each other in the laminated direction F.

Therefore, as long as the same magnetic pole of the plurality of magnets 30 arranged in the laminated direction F aligns, the magnetic pole in the upstream side of the conveying direction P may be the north pole, and the magnetic pole in the downstream side of the conveying direction P may be the south pole, for example. Although one row of the magnets 30 is provided in the conveying direction P in the present embodiment, a plurality of rows of the magnets 30 may be provided in the conveying direction P, for example. In addition, the plurality of magnets 30 may be provided such that the same magnetic pole continuously aligns.

2-3. Conveying Device 40

The conveying device 40 conveys the holding member 20 toward the magnets 30 in a direction perpendicular to the laminated direction F as the conveying direction P. In the present embodiment, the conveying device 40 not only conveys the holding member 20 toward the magnets 30 but also passes the holding member 20 over the magnets 30 to further convey the holding member 20 to the heating device 50.

Specifically, the conveying device 40 includes a pair of belts 41, 41 disposed side by side. The pair of belts 41, 41 is arranged in the conveying direction P to sandwich the magnets 30, and each has one of its ends disposed through the heating device 50. Each belt 41 is stretched over pulleys 42 at its opposite ends and is moved by rotatably driving the pulleys 42. The belt 41 includes receiving portions 43, 43 that receive the pair of holding bars 21, 21.

The pair of holding bars 21, 21 having their opposite ends supported by the receiving portions 43, 43 can be stably conveyed together with the laminate 11A by synchronizing the moving speeds of the pair of belts 41, 41. Although the conveying device 40 conveys the holding member 20 in the present embodiment, a conveying device that conveys the magnets 30 toward the holding member 20 may be provided instead of the conveying device 40, for example.

2-4. Heating Device 50

The heating device 50 heats the separated metal foils 11 to crystalize the amorphous soft magnetic material of the metal foils 11 into nano-crystal soft magnetic material. The configuration of the heating device 50 is not particularly limited, and any heating method may be used, such as infrared heating, magnetic induction heating, or heating by blowing hot air of inert gas, as long as the heating device 50 can heat the metal foils 11 under the heating conditions described later.

In the present embodiment, the heating device 50 blows on the metal foils 11 an inert gas, such as nitrogen gas, heated by a heater to heat the plurality of separated metal foils 11, 11. The heating conditions by the heating device 50 will be described in detail later in a crystallization step.

3. Method for Producing Metal Foils 11

3-1. Holding Step

Figure 2:
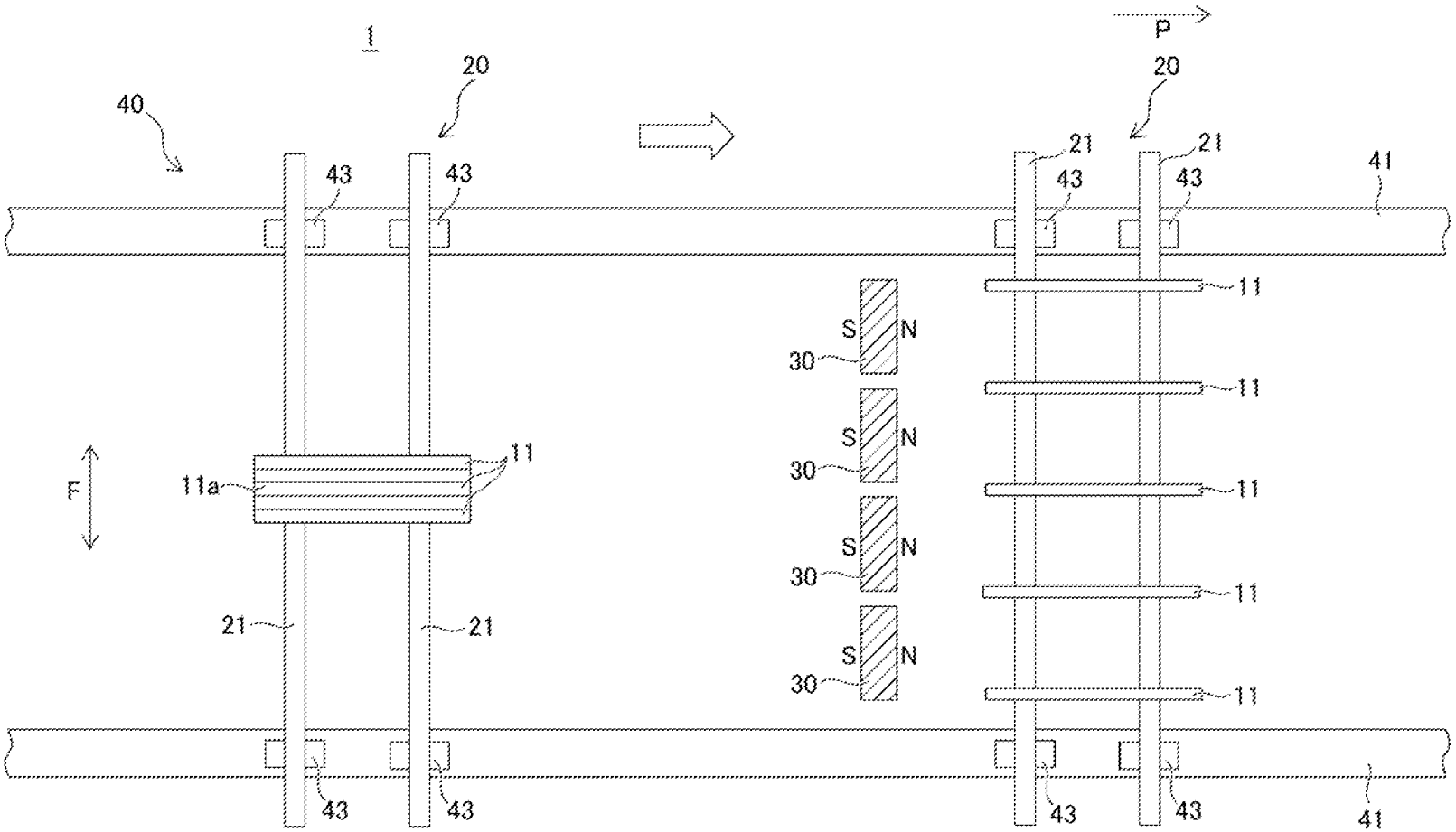
FIG. 2 is a plan view of the producing apparatus shown in FIG. 1.

A method for producing metal foils 11 using the producing apparatus 1 will be described, and an advantageous effect produced by the method will also be described. First, as shown in FIG. 1 and FIG. 2, the laminate 11A obtained by laminating the metal foils 11 made of amorphous soft magnetic material is held by the holding member 20 such that the adjacent metal foils 11, 11 can be separated from each other in the laminated direction F of the laminate 11A.

Specifically, the laminate 11A is prepared by laminating the plurality of metal foils 11, and the respective holding bars 21 are inserted into the respective through holes 11*c* formed in the laminate 11A to dispose the laminate 11A in the center of the holding bars 21. In this state, the opposite ends of the pair of holding bars 21, 21 are received by the receiving portions 43, 43.

3-2. Separating Step

The adjacent metal foils 11 are separated from each other with the magnetic force of the magnets 30 by conveying the holding member 20 toward the magnets 30 with the conveying device 40 in a direction perpendicular to the laminated direction F as the conveying direction P. Specifically, when the laminate 11A of the metal foils 11 approaches the magnets 30, the metal foils 11 forming the laminate 11A are magnetized by the magnets 30. The magnetized metal foils 11, 11 are separated from each other in the laminated direction F, and a gap is formed between the adjacent metal foils 11, 11. A gap may be 1 to 10 mm in length, and may be determined by the magnetic force of the magnets 30, for example.

In this manner, the plurality of metal foils 11, 11 can be easily arranged in a state where the metal foils 11, 11 magnetized by the magnets 30 repel each other and have a gap formed therebetween, between the magnets 30. Particularly in the present embodiment, a magnetic force (magnetic flux) oriented in the same direction tends to be formed in the laminated direction F since the same magnetic pole of the magnets 30 aligns in the laminated direction F. As a result, part of the metal foils 11 magnetized by the magnetic force is less likely to be inclined with respect to the laminated direction F, and it is possible to prevent the adjacent metal foils 11, 11 from coming into contact with each other.

Figure 3B:
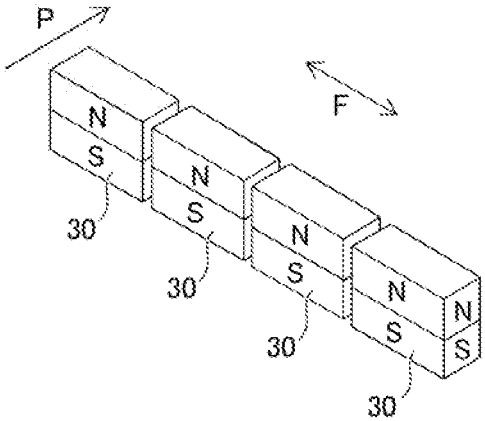
FIG. 3B is a schematic perspective view for explaining the arrangement of the magnets according to a modification of FIG. 3A.

Therefore, as long as the magnetic poles of the magnets 30 align in the laminated direction F of the laminate 11A, for example, the magnetic pole of the magnets 30 facing the holding member 20 when the holding member 20 passes over the magnets 30 may be the north pole, and the magnetic pole of the magnets 30 in the opposite side may be the south pole as shown in FIG. 3B. Furthermore, the magnetic poles of FIG. 3B may be reversed such that the magnetic pole of the magnets 30 facing the holding member 20 may be the south pole, and the magnetic pole of the magnets 30 in the opposite side may be the north pole.

Figure 4A:
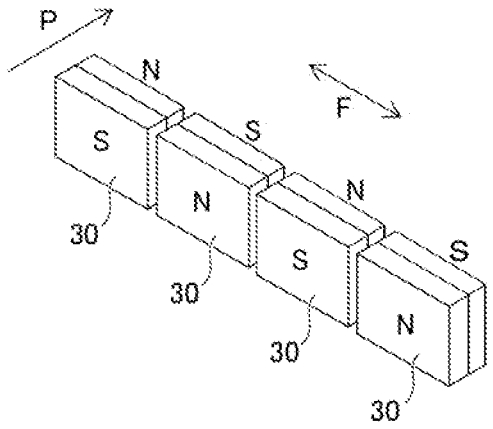
FIG. 4A is a schematic perspective view according to a comparative example of the arrangement of the magnets shown in FIG. 3A.

Herein, the inventor prepared a simplified apparatus of the producing apparatus of FIG. 1 in which the magnets were arranged as shown in FIG. 3A. Furthermore, as a comparative example, an apparatus in which the magnets 30 were alternately reversed such that the same magnetic pole of the magnets 30 did not align in the laminated direction F of the laminate 11A as shown in FIG. 4A. As a result, it was found that using the apparatus in which the magnets were arranged as shown in FIG. 3A allowed the plurality of metal foils 11, 11 to be separated from each other without coming into contact with each other. Meanwhile, it was found that when the device shown in FIG. 3B was used, part of the metal foils 11 was inclined with respect to the laminated direction, and the adjacent metal foils 11 were in contact with each other.

In view of the above, when the magnetic poles of the magnets 30 vary in the laminated direction F of the laminate 11A as shown in FIG. 4A, a magnetic force (magnetic flux) oriented in the same direction is less likely to be formed. Thus, the magnetic flux tends to flow through the adjacent magnets, and the magnetic flux of the magnets is less likely to flow through the plurality of metal foils 11, 11. As a result, it is assumed that the metal foils 11 are inclined, and the adjacent metal foils come into contact with each other.

Figure 4B:
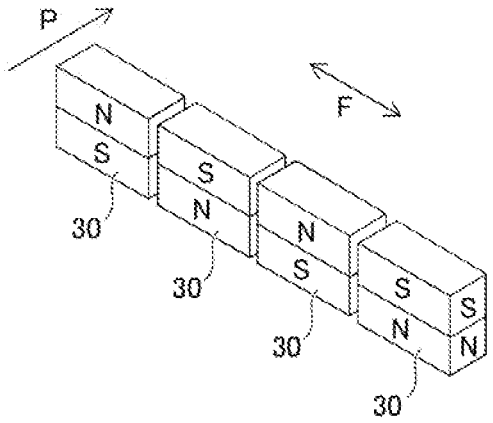
FIG. 4B is a schematic perspective view according to a comparative example of the arrangement of the magnets shown in FIG. 3B.

Accordingly, it is also assumed that the adjacent metal foils 11, 11 may come into contact with each other when the magnetic poles of the magnets 30 vary in the laminated direction F of the laminate 11A as shown in FIG. 4B, for example.

3-3. Crystallization Step

Next, the separated metal foils 11 are heated so that the amorphous soft magnetic material of the metal foils 11 is crystalized into nano-crystal soft magnetic material. Specifically, the conveying device 40 conveys the holding member 20 holding the metal foils 11 to the heating device 50 while the adjacent metal foils 11, 11 are separated from each other.

If the plurality of metal foils 11, 11 with a gap formed therebetween is heated so that the amorphous soft magnetic material is crystalized, heat is inputted to each metal foil 11. During this crystallization, each metal foil 11 generates heat by itself, but since the generated heat is discharged through the gap between the metal foils 11, 11, it is possible to avoid an excessive temperature rise of the metal foil 11. As a result, each metal foil 11 can be uniformly heated, and the metal foil 11 made of nano-crystal soft magnetic material having a uniform crystal structure can be obtained.

The conditions of heat treatment for each metal foil 11 are not particularly limited as long as the material can be crystalized, and may be appropriately selected in consideration of the composition of metal material and the desired magnetic properties to be obtained, for example. Therefore, the temperature of the heat treatment is higher than the crystallization temperature of the soft magnetic material of the metal foil, for example, though not particularly limited thereto. Accordingly, performing heat treatment on the amorphous soft magnetic material allows the amorphous soft magnetic material to change (be crystalized) into nano-crystal soft magnetic material. The heat treatment may be performed in an inert gas atmosphere.

The crystallization temperature is a temperature at which crystallization occurs. Since exothermic reaction occurs during crystallization, the crystallization temperature may be determined by measuring the temperature at which heat is generated along with the crystallization. For example, the crystallization temperature can be measured under the condition of a predetermined heating rate (e.g., 0.67 $Ks^{-1}$) using differential scanning calorimetry (DSC). The crystallization temperature of amorphous soft magnetic material is, for example, from 300 to 500° C., though it differs depending on the material used. Similarly, the crystallization temperature of nano-crystal soft magnetic material can also be measured using differential scanning calorimetry (DSC). Although nano-crystal soft magnetic material already has crystals generated therein, crystallization further progresses if the nano-crystal soft magnetic material is heated to the crystallization temperature or higher. The crystallization temperature of nano-crystal soft magnetic material is, for example, from 300 to 500° C., though it differs depending on the material used.

The heating temperature in this step is not particularly limited as long as it is equal to or higher than the temperature at which amorphous soft magnetic material crystalizes into nano-crystal soft magnetic material. For example, the heating temperature may be equal to or higher than 350° C., or equal to or higher than 400° C. Setting the heating temperature to 400° C. or higher allows crystallization to progress efficiently. Further, the heating temperature may be equal to or lower than 600° C., or equal to or lower than 520° C., for example. Setting the heating temperature to 520° C. or lower can more easily avoid excessive crystallization and suppress generation of by-products (for example, $Fe_2B$).

The heating time for the crystallization step is not particularly limited, but may be not shorter than 1 second and not longer than 10 minutes, or not shorter than 1 second and not longer than 5 minutes.

The method for heating each metal foil is not particularly limited as long as the metal foil can be uniformly heated, and any method can be used, such as heating in an atmosphere in a high-temperature heating furnace, heating with an infrared heater, heating with an electromagnetic coil, and heating with heated hot air.

However, among the above-described heating methods, the metal foil 11 may be heated with heated gas (hot air). More specifically, each metal foil 11 is heated with heated gas flowed through the gap formed between the metal foils 11, 11.

As a result, due to the gas flowing through the gap, the gas having a stable temperature flows on the surface of each metal foil 11, and thus each metal foil 11 is uniformly heated. In addition, even when the metal foil 11 generates heat by itself during crystallization, and the surface temperature of the metal foil 11 locally rises to the heating temperature or higher, since the temperature of the gas flowing on the surface is lower than the surface temperature of the metal foil 11 while it generates heat, it is possible to discharge the heat generated by the metal foil 11 to the gas passing over the surface of the metal foil 11. Accordingly, the surface temperature of the metal foil 11 can be maintained more evenly.

Second Embodiment

Hereinafter, with reference to FIG. 6 to FIG. 7B, a producing apparatus 1 according to a second embodiment will be described. The producing apparatus according to the second embodiment is different from that of the first embodiment mainly in the arrangement of the magnets. Therefore, a member having the same function is denoted by the same reference numeral, and the detailed description thereof will be omitted.

In the producing apparatus 1 according to the second embodiment, a plurality of rows of magnets, namely, magnets 30A to 30D, are arranged with a gap formed therebetween in the conveying direction P. In the present embodiment, four rows of the respective magnets 30A to 30D are arranged with a gap formed therebetween in the conveying direction P. As shown in FIG. 6 and FIG. 7A, the same magnetic pole of the magnets 30A to 30D in the respective rows aligns in the laminated direction F. Specifically, the magnetic pole in the upstream side of the conveying direction P is the south pole, and the magnetic pole in the downstream side of the conveying direction P is the north pole.

Figure 6:
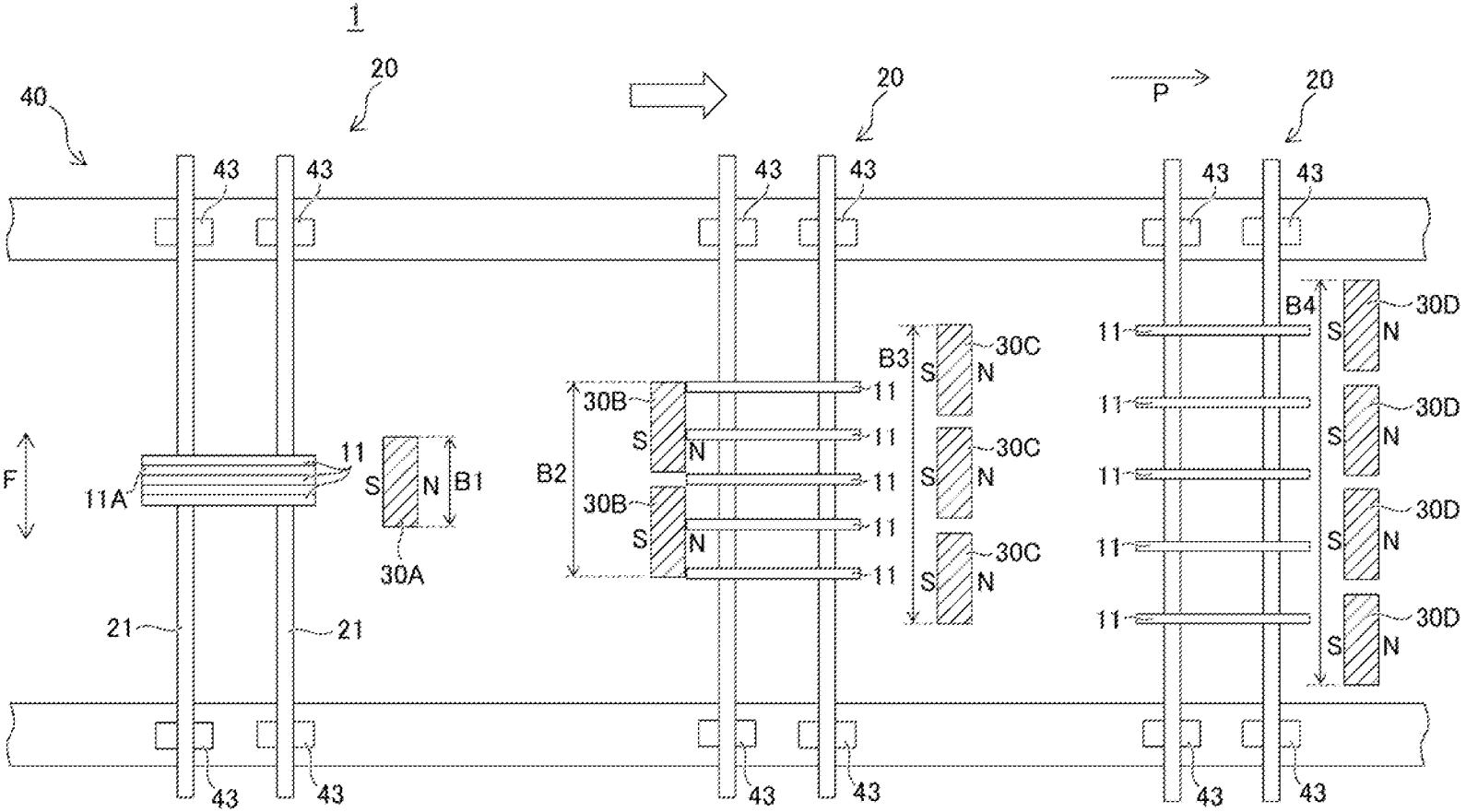
FIG. 6 is a plan view of the producing apparatus shown in FIG. 5.
Figure 7A:
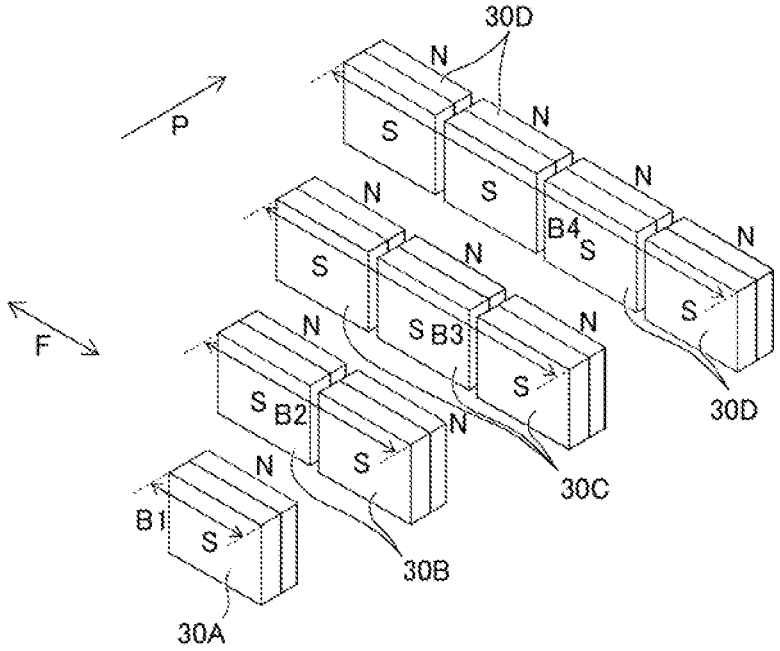
FIG. 7A is a schematic perspective view for explaining the arrangement of the magnets shown in FIG. 5.

However, the alignment of the magnetic pole of the magnets in the respective rows is not limited to the alignment of the magnetic poles shown in FIG. 6 as long as the same magnetic pole aligns in the laminated direction F. It should be noted that although each row includes a plurality of magnets in the present embodiment, each row may include only one magnet.

The magnets 30A to 30D forming the respective rows are arranged such that as the holding member 20 advances in the conveying direction P, the range of the magnetic force acting on the plurality of metal foils 11, 11 held by the holding member 20 widens in the laminated direction F. Specifically, the magnets 30A to 30D are arranged such that as the range of the magnetic force widens from the center of the plurality of metal foils 11, 11 in the laminated direction F toward the opposite sides in the laminated direction F. More specifically, from the upstream side of the conveying direction, one magnet 30A is arranged in the first row, two magnets 30B are arranged in the second row, three magnets 30C are arranged in the third row, and four magnets 30D are arranged in the fourth row in the laminated direction F, in this order.

Therefore, as compared to a range (width) B1 of the magnetic force by the magnet 30A in the first row, acting on the plurality of metal foils 11, 11 in the laminated direction F, a range (width) B2 of the magnetic force by the magnets 30B in the second row, acting on the plurality of metal foils 11, 11 in the laminated direction F, is wider.

In the same manner, as compared to the range (width) B2 of the magnetic force by the magnets 30B in the second row in the laminated direction F, a range (width) B3 of the magnetic force by the magnets 30C in the third row in the laminated direction F is wider. Further, as compared to the range (width) B3 of the magnetic force by the magnets 30C in the third row in the laminated direction F, a range (width) B4 of the magnetic force by the magnets 30D in the fourth row in the laminated direction F is wider.

With such arrangements of the magnets 30A to 30D, when the conveying device 40 sequentially passes the plurality of metal foils 11, 11 over the magnets 30A to 30D in the respective rows in the conveying direction P, the adjacent metal foils 11, 11 are gradually separated from each other with a larger gap therebetween in the laminated direction F. Accordingly, the magnetized metal foils 11, 11 are less likely to be inclined with respect to the laminated direction F, and it is possible to prevent the adjacent metal foils 11, 11 from coming into contact with each other.

Figure 7B:
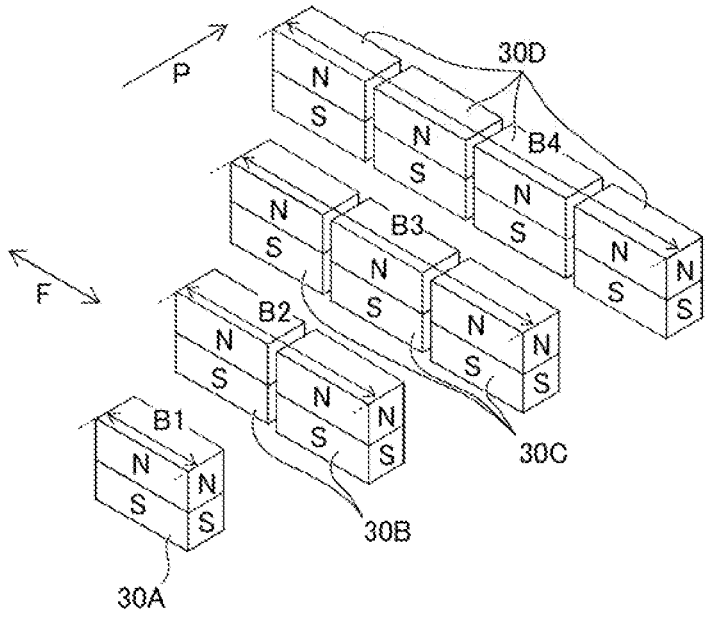
FIG. 7B is a schematic perspective view for explaining the arrangement of the magnets according to a modification of FIG. 7A.

In the present embodiment as well, as long as the magnetic poles of the magnets 30A to 30D in the respective rows can align in the laminated direction F of the laminate 11A, for example, the magnetic pole of the magnets 30A to 30D facing the holding member 20 when the holding member 20 passes over the magnets may be the north pole, and the magnetic pole of the magnets 30A to 30D in the opposite side may be the south pole as shown in FIG. 7B. Furthermore, the magnetic poles of FIG. 7B may be reversed such that the magnetic pole of the magnets 30A to 30D facing the holding member 20 may be the south pole, and the magnetic pole of the magnets 30A to 30D in the opposite side may be the north pole.

Figure 5:
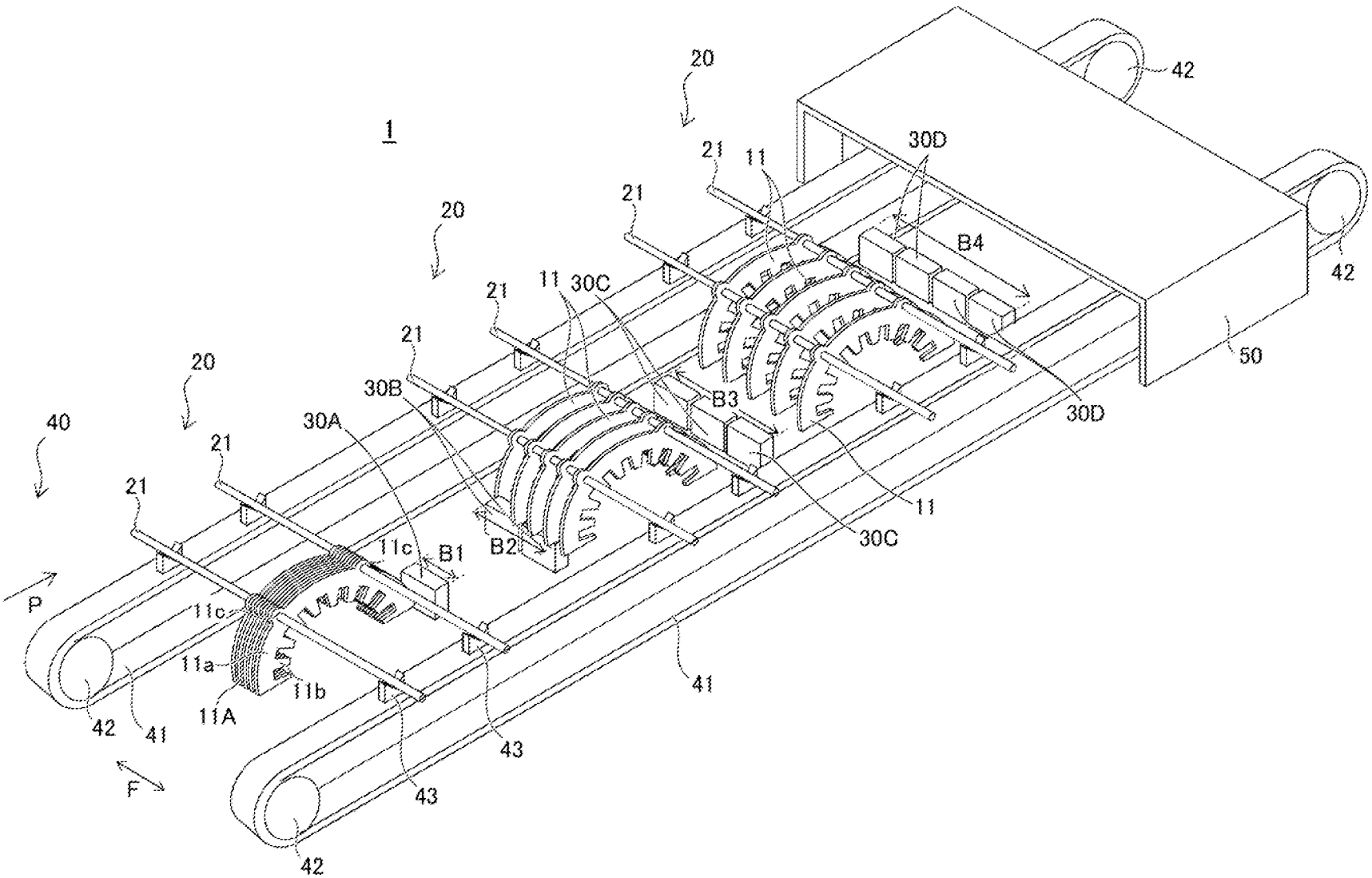
FIG. 5 is a schematic perspective view showing a producing apparatus adapted to perform a method for producing metal foils according to a second embodiment of the present disclosure.

Herein, the inventor prepared a simplified apparatus of the producing apparatus of FIG. 5 in which the magnets are arranged as shown in FIG. 7A. It was found that using the apparatus in which the magnets are arranged as shown in FIG. 7A allowed the plurality of metal foils 11, 11 to be separated from each other at equal intervals.

The metal foils 11, 11 produced in the first embodiment and the second embodiment are brought into close contact with each other with a predetermined pressure to form a laminate 10A. At this time, the metal foils 11 may be tied to each other with a resin such as an adhesive, for example. In the present embodiment, since the holding bar 21 is inserted into each of the through holes 11*c* of the metal foils 11, the laminate 10A can be easily produced without requiring alignment of the plurality of metal foils 11, 11.

Figure 8A:
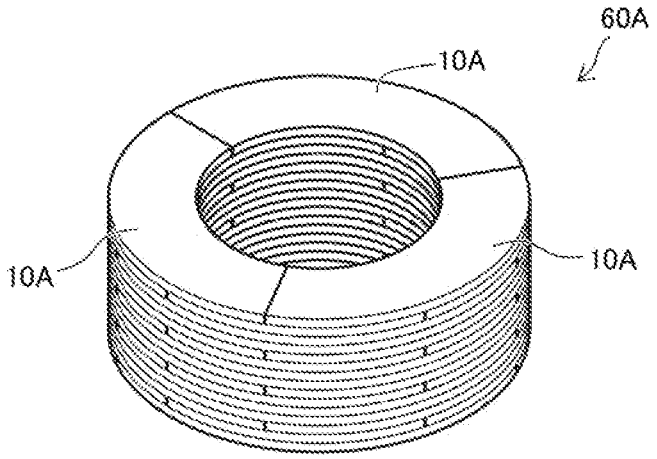
FIG. 8A is a schematic perspective view for explaining a step of producing a rotor core.

Furthermore, as shown in FIG. 8A, a plurality of such laminates 10A is stacked in the state of a stator core and fixed, whereby a stator core 60A is produced. It should be noted that the detailed shape of teeth of the stator core and the like are omitted in FIG. 8A and FIG. 8B.

Figure 8B:
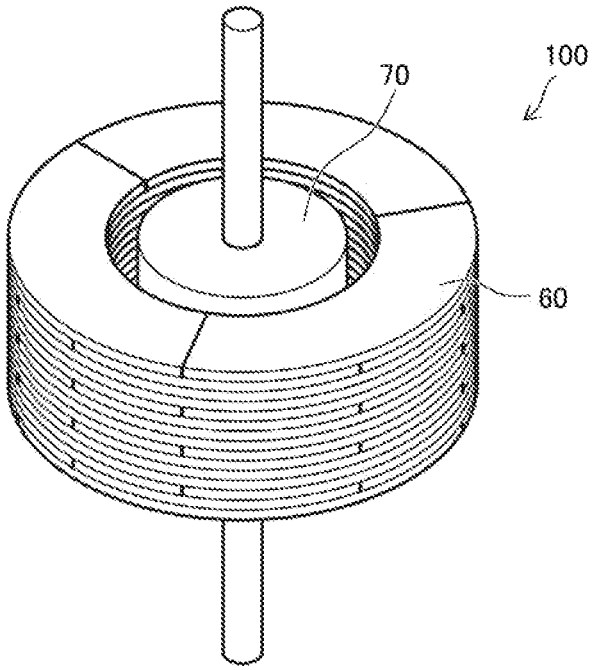
FIG. 8B is a schematic perspective view for explaining a step of producing a motor.

Finally, an assembling step is performed as shown in FIG. 8B. In this step, a coil (not illustrated) is disposed on teeth (not illustrated) of the stator core to form a stator 60, and the stator 60 and a rotor 70 are disposed in a case (not illustrated), whereby a motor 100 is produced.

While the embodiments of the present disclosure have been described in detail above, the present disclosure is not limited thereto, and can be subjected to various kinds of changes of design without departing from the spirit and scope of the present disclosure described in the claims.

In the present embodiment, a stator core of a motor is produced by laminating metal foils made of nano-crystal soft magnetic material, but a rotor core of a motor may be produced by laminating metal foils.

What is claimed is:

1. An apparatus for producing metal foils made of nano-crystal soft magnetic material, the apparatus comprising:

a holding member configured to hold a laminate obtained by laminating metal foils made of amorphous soft magnetic material such that adjacent metal foils can be separated from each other in a laminated direction of the laminate;

one or more magnets configured to separate the adjacent metal foils in the laminate held by the holding member with a magnetic force;

a conveying device configured to convey either the holding member or the one or more magnets in a direction perpendicular to the laminated direction as a conveying direction such that the holding member and the one or more magnets come close to each other; and a heating device configured to heat the separated metal foils to crystalize the amorphous soft magnetic material of the metal foils into nano-crystal soft magnetic material, wherein a same magnetic pole of the one or more magnets aligns in the laminated direction.

2. The apparatus for producing metal foils according to claim 1, wherein a plurality of rows each including the one or more magnets is arranged with a gap therebetween in the conveying direction, and the one or more magnets forming the plurality of rows are arranged such that a range of the magnetic force acting on the metal foils widens in the laminated direction as the holding member advances in the conveying direction.

* * * * *